United States Patent [19]

McKinney, Sr. et al.

[11] 4,135,267

[45] Jan. 23, 1979

[54] UTILITY BELT BUCKLE

[76] Inventors: Kenneth D. McKinney, Sr.; Kenneth D. McKinney, Jr., both of Box 23A, Rte. 2, Apache Junction, Ariz. 85220

[21] Appl. No.: 812,789

[22] Filed: Jul. 5, 1977

[51] Int. Cl.[2] ..... B25F 1/00

[52] U.S. Cl. ..... 7/151; 7/158; 24/77 R; 24/163 K; 24/176; 24/186

[58] Field of Search ..... 7/1 C, 1 H, 14.1 R, 7/14.2 R, 14.6, 14.25; 24/163 KO, 176, 186, 77, 187

[56] References Cited

U.S. PATENT DOCUMENTS

| | | | |
|---|---|---|---|
| 58,430 | 10/1866 | Kelsey | 24/77 R |
| 60,579 | 12/1866 | Sherman | 24/77 R |
| D. 152,727 | 2/1949 | Peterson | 7/1 H |
| 645,845 | 3/1900 | Barnett | 24/77 R |
| 719,152 | 1/1903 | Sleeth | 24/77 R |
| 1,178,024 | 4/1916 | Nettleton | 24/188 |
| 1,481,911 | 1/1924 | Kalk | 24/77 R |
| 1,483,338 | 2/1924 | Dilling | 24/187 X |
| 1,491,428 | 4/1924 | Starmer | 24/77 R |
| 1,877,019 | 9/1932 | Nathan | 7/14.6 |
| 2,118,159 | 5/1938 | Castner | 7/14.6 |
| 2,364,333 | 12/1944 | Wisher | 7/1 H |
| 2,405,271 | 8/1946 | Siegel | 24/77 R |
| 2,807,085 | 9/1957 | Combs | 7/1 C |
| 3,175,233 | 3/1965 | Caravella | 7/14.25 |
| 3,727,247 | 4/1973 | Miller | 7/14.25 |
| 3,823,421 | 7/1974 | Collins | 7/14.6 |
| 3,823,422 | 7/1974 | Forgett | 24/77 R |
| 3,885,271 | 5/1975 | Kollander | 7/1 H |

FOREIGN PATENT DOCUMENTS

| | | | |
|---|---|---|---|
| 667062 | 10/1938 | Fed. Rep. of Germany | 24/77 R |
| 802610 | 1/1951 | Fed. Rep. of Germany | 7/14.25 |
| 820407 | 8/1937 | France | 7/14.25 |
| 1138216 | 1/1957 | France | 7/14.25 |
| 306596 | 7/1955 | Switzerland | 7/14.25 |
| 420744 | 11/1934 | United Kingdom | 24/77 R |

*Primary Examiner*—Al Lawrence Smith
*Assistant Examiner*—J. T. Zatarga
*Attorney, Agent, or Firm*—James W. McFarland

[57] ABSTRACT

A combination utility belt buckle having one end configured as a prying type bottle opener, the opposite end configured as a piercing type can opener, a shiftable can cutting blade disposed along one elongated edge of the belt buckle, and the other edge of the buckle presenting a knife edge and an improved fish scaler. The buckle is configured to facilitate rapid assembly and disassembly from a belt without removal of the belt from the wearer.

6 Claims, 6 Drawing Figures

UTILITY BELT BUCKLE

BACKGROUND OF THE INVENTION

This invention relates to an improved utility belt buckle of particular convenience to sportsmen, outdoorsmen and campers.

Easily transportable compact, and effective utility tools, particularly those for cutting or opening cans, bottles, and the like are of great convenience to outdoorsmen. Exemplary of prior art structures of belt buckles which incorporate one or more such utility tools may be found in U.S. Pat. Nos. 1,267,052; 2,470,606; 2,807,085; Design 183,727; and Norweigan Pat. No. 61627. None of the above referenced disclosures contemplate improved structure as presented by the present invention.

SUMMARY OF THE INVENTION

One important object of the present invention is to provide an improved arrangement to facilitate easy assembly and disassembly of a utility belt buckle from a belt without removal of the latter from the wearer.

Another important object is to provide in combination with a conventional belt, a utility belt buckle which has a prying type bottle opener configuration at one end, which bottle opener configuration is rapidly releaseable and interlockable with a rigid, closed metallic loop carried at one end of the belt to facilitate easy removal of the buckle from the belt without requiring removal of the latter from the wearer.

Another important object of the present invention is to provide an improved utility belt buckle configuration which includes a prying type bottle opener, a piercing can opener, and a can cutting device which are compactly and efficiently incorporated within the belt buckle for easy, safe and convenient use, yet which are so arranged that upon wearing the belt buckle the utility items afford minimal chance for accident to the wearer.

These and other more specific objects and advantages of the present invention are specifically set forth or will become apparent from the following detailed description of the preferred form of the invention when read in conjunction with the accompanying drawing.

DETAILED DESCRIPTION OF THE PREFERRED EMBODIMENT

Figure 1:
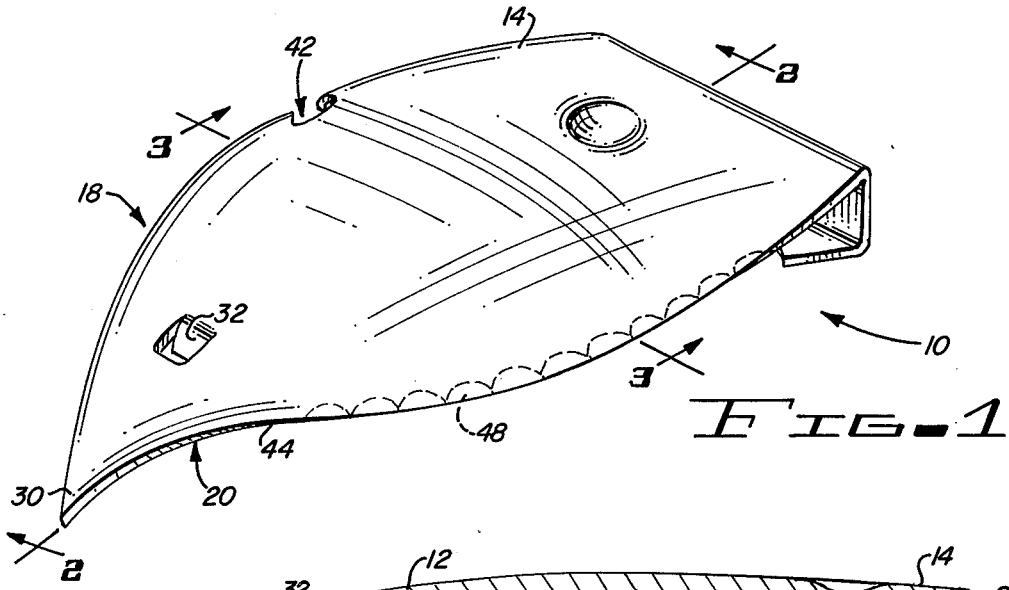
FIG. 1 is a perspective illustration of a utility belt buckle as contemplated by the present invention.

Referring now more particularly to the drawing, there is illustrated a utility belt buckle generally designated by the numeral 10 which includes a major longitudinally extending body portion 12 having a convex outer surface 14 and a concave lower or inner surface

Figure 4:
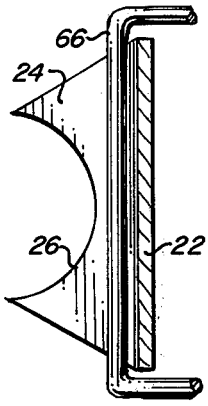
FIG. 4 is a plan cross-sectional view of the prying type bottle opener taken along lines 4—4 of FIG. 2.

16 bounded by laterally curved longitudinally extending edges 18 and 20. Integral with one longitudinal end of body 12 and extending across the lateral width thereof is a downwardly depending transverse stretch 22, and a longitudinal stretch 24 underlying and transversely spaced from the end of body 12. As shown in FIG. 4 the longitudinal stretch 24 includes a semi-circular cut-out 26 adapted to receive the lid of a bottle. A circular depression and corresponding protrusion 28 on lower surface 16 is spaced longitudinally inwardly of transverse stretch 24 and is cooperable therewith to define a prying type of bottle opener.

Figure 2:
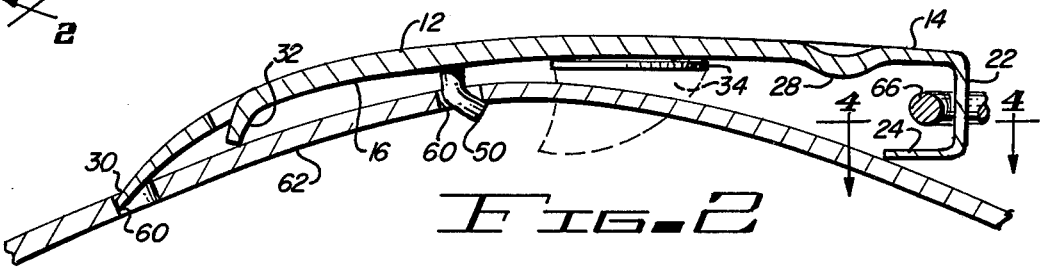
FIG. 2 is an elevational cross-sectional view taken generally along lines 2—2 of FIG. 1 and projected on the contour of curvature of the buckle and showing portions of an associated belt.
Figure 3:
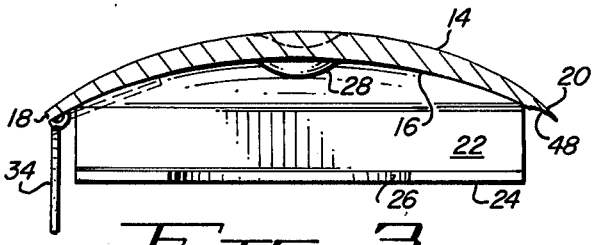
FIG. 3 is a transverse elevational cross-sectional view taken along lines 3—3 of FIG. 1.
Figure 5:
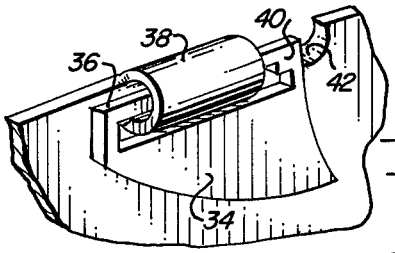
FIG. 5 is a fragmentary, enlarged, perspective view of the cutting can opener utility item.

The opposite longitudinal end of body 12 is laterally tapered to a central piercing point 30, and a centrally located, rigid, downturned tab 32 is cooperable with piercing point 30 to present a piercing type of can opener at this opposite end of the major body 12. Secured at edge 18 of the body is a shiftable can cutter element 34 which depends transversely downwardly from edge 18 in its operating position illustrated in FIGS. 2 and 3, and lies flat against surface 16 in its stored position of FIG. 5. The can cutting element 34 has a longitudinal section 36 permanently, shiftably received with a rolled section 38 of edge 18. One end of segment 36 has an enlarged section 40 which is shiftable in and out of the interior of roll 38 to assist in holding the can cutting plate in either its depending operating position or its stored disposition. A relief 42 in edge 18 facilitates shifting of the cutting element 34 between its operating end stored disposition.

A first section of the opposite edge 20 of the body 12 is laterally tapered to a sharp knife edge 44. Either the top surface 14 as shown, or lower surface 16 may be tapered to present honed edge 44. Adjacent knife edge 44 is another section wherein scalloped depressions 48 are incorporated on the lower surface 16 of edge 20. The scalloped depressions 48 are operable as a fish scaler, and it has been found that the combination of the location of the fish scaler section at the edge 20 and on the concavely curved lower surface 16, provides an improved fish scaler since removed scales tend to collect on the concave lower surface 16. The concavity of lower surface 16 as well as the longitudinally curved configuration of the buckle provides an arrangement fitting appropriately within the palm of the user's hand, and more nearly conforming to the natural curvature of fish being scaled.

Figure 6:
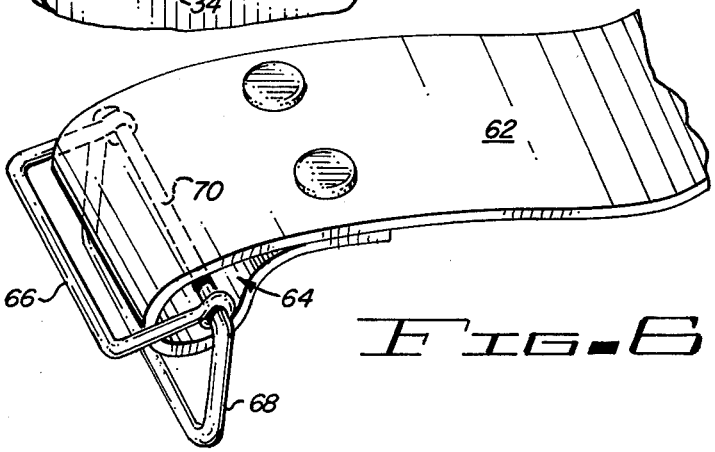
FIG. 6 is a perspective view of a portion of the end of the belt.

Permanently secured to lower surface 16 is a downwardly transversely depending, reversely turned hook element 50 which is insertable through one of a series of spaced eyelet apertures 60 at one end of a conventional belt 62. Hook 50 is longitudinally spaced relative to piercing point 30 such that upon insertion of hook 50 into eyelet 60, the piercing point 30 is received within the next adjacent eyelet 60 of the belt to prevent damage to the belt as well as to provide a surrounding sheath for piercing point 30 when the belt buckle is being worn. As illustrated in FIGS. 1 and 6 the opposite end of the belt 62 has a closed end defining a laterally extending opening 64, and a pair of rigid, metal loops 66, 68 loosely carried within opening 64. Preferably the two rigid, closed loops 66 and 68 have a common hinged section 70 within opening 64. The larger loop 68 extends downwardly substantially below the stretches 22, 24 of the belt buckle to present a loop for receiving the opposite end of the belt 62 by the wearer in underlying relationship to the end of the belt carrying loops 66 and 68.

Loop 66 is configured and arranged to be readily and easily received across longitudinal stretch 24 to interlock with the transverse and longitudinal stretches 22, 24. In this manner it will be seen that the interlocking loop 66 and the stretches 22, 24 permit ready and easy disassembly and assembly of the belt buckle to the end of the belt without requiring removal of the belt from the wearer. This feature greatly enhances the utility of the buckle in acting as a bottle or can opener, fish scaler or knife since the wearer may rapidly remove the buckle by slipping the loop 66 across open longitudinal stretch 24.

The preceding detailed description of a preferred embodiment of the invention should be considered exemplary in nature and not as limiting to the scope and spirit of the invention as set forth in the appended claims.

Having described the invention with sufficient clarity that those skilled in the art may make and use it, we claim:

1. For use in combination with a belt having eyelet apertures spaced longitudinally along one end thereof:

a pair of rigid loops carried at an opposite end of said belt, said pair of loops being secured together and extending generally laterally across said opposite end of the belt, one of said pair of loops arranged for receiving said one end of said belt in underlying relationship to said opposite end of the belt; and a unitary buckle underlying said belt and including a major body with a lower surface thereof extending longitudinally along in overlying relationship to said belt, said buckle including a first rigid stretch integral with one end of said body and extending laterally across the width of said one end of the body, said first stretch depending transversely downwardly from said one end of the body, said buckle further including a second rigid stretch integral with said first stretch and extending longitudinally therefrom in underlying, transversely spaced relationship to said lower surface of the major body, said second stretch being readily inserted into and removed from the other of said pair of loops for releasably interlocking said other of the pair of loops with said first and second stretches to facilitate rapid assembly and disassembly of said buckle to said belt, said second stretch having a semi-circular cut-out and said major body having a protrusion on said lower surface facing said cut-out, whereby said major body and said second stretch together present a prying-type bottle lid remover.

2. A combination as set forth in claim 1, wherein said pair of loops are hinged together for relative pivoting along an axis extending generally laterally across said opposite end of the belt.

3. A combination as set forth in claim 2, wherein an end of said major body opposite side one end thereof is laterally tapered to a substantially central, sharp piercing point, said major body having a centrally located, downturned tab cooperable with said piercing point to present a piercing-type can opener.

4. A combination as set forth in claim 3, further including cutting means shiftably secured to said body at a longitudinally extending edge thereof, said cutting means shiftable between an operating position depending downwardly from said edge of the body to present a can cutting blade, and a stored position lying substantially flat against a lower surface of said major body.

5. A combination as set forth in claim 4, wherein said body includes another longitudinally extending edge, a portion of said another longitudinally extending edge being transversely tapered to a sharp knife edge.

6. A combination as set forth in claim 5, wherein said major body is relatively smoothly curved to present a convex outer surface thereof, said lower surface being correspondingly concave, another portion of said another longitudinally extending edge of the body having scalloped depressions along said lower surface.

* * * * *